US005445553A

United States Patent [19]

Cryer et al.

[11] Patent Number: 5,445,553

[45] Date of Patent: Aug. 29, 1995

[54] METHOD AND SYSTEM FOR CLEANING A SURFACE WITH $CO_2$ PELLETS THAT ARE DELIVERED THROUGH A TEMPERATURE CONTROLLED CONDUIT

[75] Inventors: Michael A. Cryer, Byron; William D. Danielson, Decatur; Robert A. Babb, Warner Robins, all of Ga.

[73] Assignee: The Corporation of Mercer University, Macon, Ga.

[21] Appl. No.: 7,518

[22] Filed: Jan. 22, 1993

[51] Int. Cl.[6] ..... B24B 49/14; B24C 3/12

[52] U.S. Cl. ..... 451/7; 451/39; 451/40; 451/75; 451/90

[58] Field of Search ..... 51/165.73, 165.74, 320, 51/322, 317, 318, 319, 321, 410, 427, 428, 436, 439; 134/7, 13; 451/7, 39, 40, 75, 90

[56] References Cited

U.S. PATENT DOCUMENTS

| | | | |
|---|---|---|---|
| 4,038,786 | 8/1977 | Fong | 51/320 |
| 4,744,181 | 5/1988 | Moore et al. | 51/436 |
| 4,780,119 | 10/1988 | Brooke | 62/12 |
| 4,924,643 | 5/1990 | Buiguez et al. | 51/322 |
| 4,924,643 | 5/1990 | Buiguez et al. | 51/322 |
| 4,947,592 | 8/1990 | Lloyd et al. | 51/436 |
| 4,965,968 | 10/1990 | Kelsall | 51/320 |
| 5,018,667 | 5/1991 | Lloyd | 239/132.5 |
| 5,050,805 | 9/1991 | Lloyd et al. | 239/424 |
| 5,063,015 | 11/1991 | Lloyd et al. | 264/161 |
| 5,071,289 | 12/1991 | Spivak | 406/11 |
| 5,109,636 | 5/1992 | Lloyd et al. | 51/320 |
| 5,184,427 | 2/1993 | Armstrong | 51/165.73 |
| 5,222,332 | 6/1993 | Mains, Jr. | 51/322 |

*Primary Examiner*—Bruce M. Kisliuk
*Assistant Examiner*—Eileen P. Morgan
*Attorney, Agent, or Firm*—Jones & Askew

[57] ABSTRACT

A system and method for cleaning or removing coatings, such as paint, from a surface with a stream of particles. A carbon dioxide ($CO_2$) pelletizer forms carbon dioxide pellets, which are delivered by a delivery system against a surface to be cleaned. The delivery system includes a hopper for containing the pellets and a high pressure air supply. A feeder introduces the pellets from the hopper into the high pressure air. The combined high pressure air and pellets are directed along a delivery hose to a nozzle, which directs the air and pellets against a surface to be cleaned. Temperature sensors are provided to monitor the temperature of the pressurized air at various points in the delivery system. Signals from the temperature sensor are provided in a feedback control manner to a control valve. The control valve controls the introduction of liquid nitrogen ($N_2$) into the air stream at a mixing chamber in the delivery system. In accordance with the invention, the temperature sensors and feedback controls permit maintenance of the temperature of the high pressure air below the sublimation temperature of the pellets as the pellets are delivered by the delivery system, thereby prolonging the life of the pellets and reducing sublimation prior to ejection from the nozzle.

27 Claims, 5 Drawing Sheets

METHOD AND SYSTEM FOR CLEANING A SURFACE WITH $CO_2$ PELLETS THAT ARE DELIVERED THROUGH A TEMPERATURE CONTROLLED CONDUIT

GOVERNMENT RIGHTS

This invention was made with Government support under Contract Nos. F09603-90-G-0016/Q601 and F09603-87-G-0695/Q601 awarded by the Department of Defense (U.S. Air Force). The Government has certain rights in the invention.

TECHNICAL FIELD

The present invention relates generally to cleaning surfaces with a stream of particles, and relates more specifically to a method and system that effectively propels particles comprising solid carbon dioxide ("$CO_2$") pellets at high speeds onto a coated surface to remove the coating in a rapid but environmentally benign manner.

BACKGROUND OF THE INVENTION

Many types of articles require cleaning or removal of coatings. Removing hardened coatings such as paint from a surface can be difficult, time consuming, and costly. Moreover, certain removal methods generate significant amounts of environmentally hazardous wastes.

One example is the removal of paint from the surface of aircraft. Military aircraft especially have need for periodic removal of worn or damaged paint. Military aircraft are painted for purposes of camouflage, structural integrity, reduction of radar reflectivity, etc. Once an aircraft is painted, it must be periodically stripped and repainted as new paints become available or as old paint coats become worn or damaged. Known paint stripping methods are time consuming and expensive. Because known paint removal processes take so much time, the aircraft is either out of commission for a lengthy period of time or must be flown with a compromised coating.

Three methods are currently in use for removing paint from the surface of aircraft. A first method uses chemical solvents, typically petroleum-based, to remove the paint from the aircraft surface. The chemical method produces approximately 17,000 pounds of hazardous liquid waste byproducts for a military fighter aircraft such as an F-15. Use of chemical solvents requires protective clothing and respirators during the stripping process, and procedures for collecting and storing the hazardous waste byproducts. Such measures significantly increase the cost of the process and are a threat to the quality of the environment.

A second known paint removal method involves blasting with media such as plastic pellets. The plastic pellets are blasted with high pressure air onto the surface to be cleaned. The impact of the pellets causes the physical removal of the paint by abrasion. As with chemical solvents, use of plastic pellet blasting require the use of protective clothing and respirators. This process produces significant amounts of waste in the form of plastic pellets mixed in with paint chips. The collection and disposal of the plastic pellets and paint chips is time consuming.

A third paint removal method physically removes paint from the surface of an aircraft using media comprising particles of solid $CO_2$ instead of plastic. The carbon dioxide or "dry ice" is formed into solid pellets and propelled at high speed onto the surface of the aircraft. The impact of the dry ice pellet chips the paint off the aircraft surface. At ambient temperatures and pressures, the $CO_2$ pellets evaporate into the atmosphere through a process known as sublimation. After the $CO_2$ pellets sublimate, the only remaining by-products of this paint removal process are dried paint chips.

A $CO_2$ pellet removal system produces about 240 pounds of dried paint chips for an F-15 aircraft. In comparison to the chemical stripping process, the CO2 process produces 70 times less waste. Advantageously, the dried paint chips are easier to gather up and confine, and the process does not produce environmentally hazardous byproducts that must be separately handled and disposed. Moreover, methods of paint removal involving use of $CO_2$ pellets are considered environmentally benign since the $CO_2$ is usually obtained as a byproduct of other industrial processes, and no new $CO_2$ is introduced into the atmosphere.

Present $CO_2$ paint removal systems typically include a liquid $CO_2$ storage tank, a pelletizer that converts $CO_2$ from liquid into solid pellet form, a feeder that feeds the $CO_2$ pellets into a stream of high pressure air, a conduit or hose connected to the feeder, and a nozzle. One example of a paint removal system and method that employs $CO_2$ pellets as particulate media is described in U.S. Pat. No. 5,109,636 to Lloyd et at., entitled "Particle Blast Cleaning Apparatus and Method".

Known $CO_2$ paint removal systems have certain drawbacks. For example, most known systems are inefficient since only a small portion of the $CO_2$ pellets produced by the pelletizer are ultimately ejected from the nozzle. Some of the inefficiency is believed due to the temperature difference between the nozzle and point at which the pellets are introduced into the pressurized air stream, which can be several degrees. Moreover, the temperature of the pressurized air stream into which the pellets are introduced is typically many degrees warmer than the temperature of the $CO_2$ pellets.

The present inventors have discovered that only about 18% of the pellets actually produced by the pelletizer in known prior art systems ultimately reach the aircraft surface. It it believed that a substantial portion of the $CO_2$ pellets sublimate prior to exiting the blast nozzle. The number of pellets that actually impact the surface to be cleaned affect the overall efficiency of the system and the rate of cleaning.

Known $CO_2$ paint removal systems also cause undesirable backside paint removal under certain conditions. Aircraft surfaces having a thickness of 0.040 inches or less sometime experience partial removal of paint from the opposite or "backside" of the surface. The problem seems to occur most often when larger size pellets are used (greater than 0.080 inches in diameter), which apparently impact the surface with such force that a localized deflection is created that passes through the metal to the back side of the surface, where it contributes to removal of paint from that surface.

Accordingly, there is a need for an improved $CO_2$ pellet cleaning system that is more efficient in terms of pellet survival and provides better cleaning ability than prior art systems. In this regard, there is a need for an improved $CO_2$ pellet cleaning method and system that reduces sublimation of the $CO_2$ pellets before they are propelled from the nozzle.

SUMMARY OF THE INVENTION

As will be seen, the present invention overcomes these and other disadvantages associated with prior art particle blast cleaning removal methods and systems. Stated generally, the present invention includes a means for providing $CO_2$ particles as media for blast cleaning, a delivery system for delivering the particles against a surface to be cleaned, and a means for controlling the temperature in the delivery system so as to prolong the life of the $CO_2$ particles during passage through the delivery system.

More particularly described, the present invention comprises means for forming liquid $CO_2$ into solid pellet form, a $CO_2$ pellet collecting means, means for introducing the $CO_2$ pellets into a stream of high pressure air, a delivery conduit, a nozzle, and a means for controlling the temperature of the high pressure air within the system at a predetermined level, preferably at or below the liquid phase temperature of $CO_2$ pellets. The delivery conduit connects the introducing means to the nozzle and enables the $CO_2$ pellets and high pressure air to travel therethrough. The controlling means maintains the temperature of the high pressure air within the system to eliminate melting and sublimation within the system and deliver substantially all of the $CO_2$ pellets to the nozzle. Because virtually all of the $CO_2$ pellets introduced into the delivery system survive the passage through the delivery system with the use of the present invention, increased efficiencies are possible in terms of surface area cleaned per unit time.

Another aspect of the present invention involves an improved method of cleaning a surface utilizing $CO_2$ pellets. The method includes the steps of forming liquid $CO_2$ into solid pellet form, introducing the $CO_2$ pellets into a stream of high pressure air, causing the pellets to travel through a conduit of a predetermined length, controlling the temperature of the high pressure air within the delivery system at or below a predetermined temperature, and propelling the $CO_2$ pellets from a nozzle so that the pellets impact a surface to be cleaning, which impact causes the surface to be cleaned. The step of controlling the temperature in the system results in substantially improved survival of the pellets as they travel from the pelletizer to the nozzle outlet.

Using a $CO_2$ pellet cleaning system constructed in accordance with the invention, substantially all of the pellets actually produced in the pelletizer survive the travel through the conduit and are propelled through the nozzle and against a surface to be cleaned. This results from cooling and maintaining the temperature within the system below the sublimation point of $CO_2$ (i.e., below $-109°$ F.). This increase in efficiency has resulted in an eight-fold decrease in strip time of a typical aircraft, for example, a decrease from 136 hours to only 17 hours. As a further example, use of the present invention for removing paint from F-15 fighter planes could enable savings of $3 million per year over prior art chemical de-painting processes, and $2 million per year over existing $CO_2$ paint removal systems.

Accordingly, it is an object of the present invention to provide an improved $CO_2$ particle cleaning method and system.

It is a further object of the present invention to provide an improved $CO_2$ pellet cleaning method and system that substantially reduces melting and sublimation of $CO_2$ pellets within the system, prior to ejection of the pellets from a nozzle against a surface to be cleaned.

It is a further object of the present invention to provide an improved $CO_2$ pellet cleaning method and system having increased cleaning efficiency due to increased rates of pellet ejection from cleaning nozzles.

It is yet a further object of the present invention to provide an improved $CO_2$ pellet cleaning method and system that maintains the benefits of known $CO_2$ cleaning systems with minimal, non-hazardous waste byproducts.

Other objects, features and advantages of the present invention will become apparent upon reading the following specification when taken in conjunction with the drawings and the appended claims.

BRIEF DESCRIPTION OF THE DRAWING FIGURES

DETAILED DESCRIPTION OF THE PREFERRED EMBODIMENT

Figure 1:
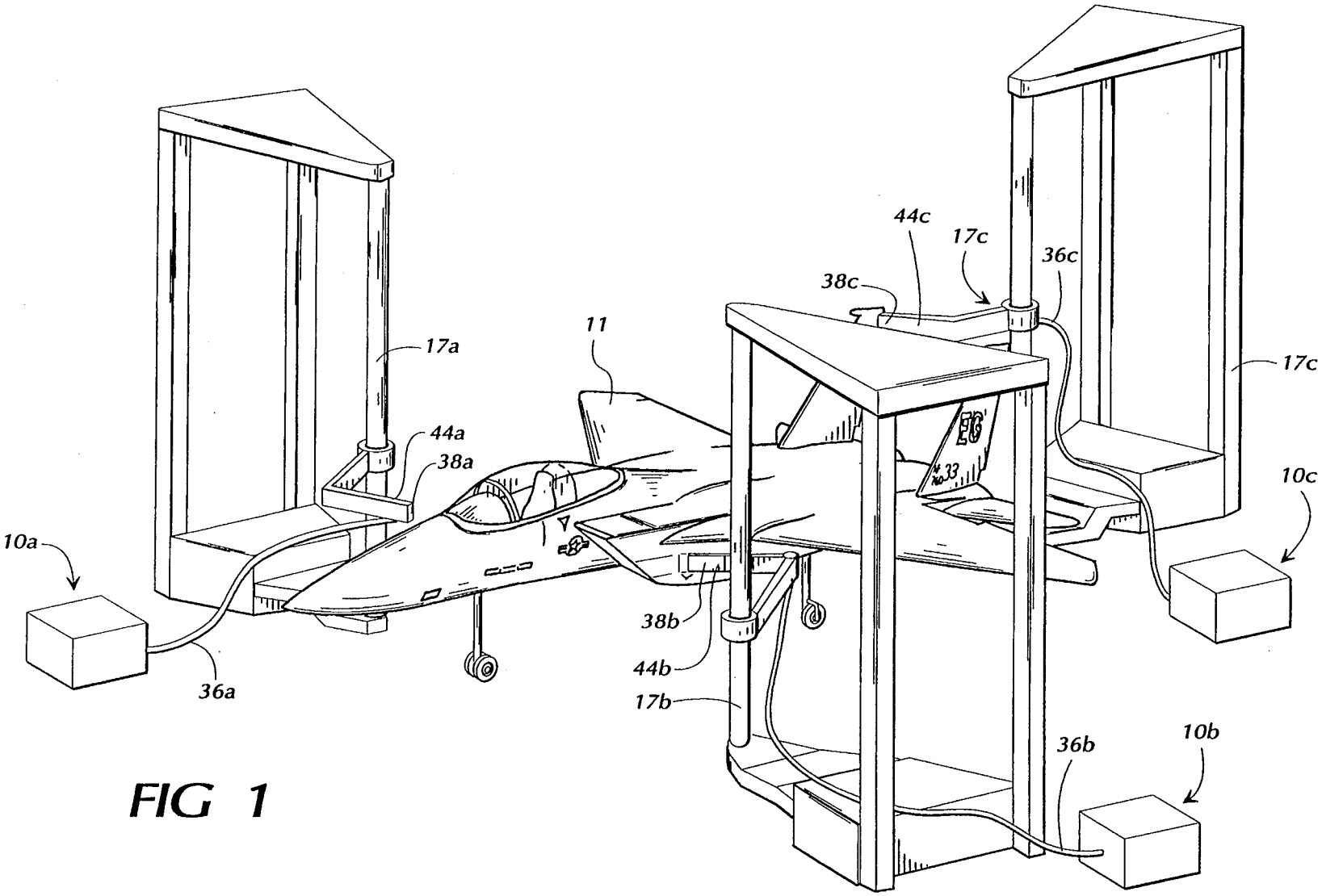
FIG. 1 is an isometric view of a $CO_2$ particle cleaning system as applied to the removal of paint from a painted military aircraft.

Referring now to the drawings, in which like numerals indicate like elements throughout the several views, FIG. 1 illustrates a plurality of identically constructed $CO_2$ particle media cleaning systems 10*a*, 10*b*, 10*c* constructed in accordance with the preferred embodiment of the present invention, as applied to the cleaning of an article, in this case a military aircraft 11. Each system 10*a*, 10*b*, 10*c* is shown used in conjunction with a robot 17*a*, 17*b*, 17*c* that is configured to support and move a delivery system comprising a robot arm 44*a*, 44*b*, 44*c* supporting a nozzle 38*a*, 38*b*, 38*c* along a path adjacent to the aircraft 11, to remove paint from the aircraft in an automated fashion. Each nozzle 38*a*, 38*b*, 38*c* receives $CO_2$ pellets and pressurized air via a feed hose 36*a*, 36*b*, 36*c* connected to its respective system 10.

Although a plurality of systems 10*a*, 10*b*, 10*c* are shown, a single system 10 will be described. Moreover, while the present invention is shown in conjunction with the cleaning of an aircraft in an automated fashion, it will be understood that the invention has applicability to other types of article cleaning, automated or manual, and is not limited to aircraft paint stripping.

For an application such as aircraft paint removal, a preferred configuration is to provide one or more robots such as the robots 17*a, b, c* positioned to assume fight side, left side, and rear positions, respectively, adjacent the aircraft. Each robot 17 is equipped with at least one selectively positionable robot arm 44 that movably supports at least one nozzle 38 and a feed hose 36 connected to a cleaning system 10. Programming allows each of the side robots to cover approximately 40% of the skin surface. The rear robot may cover the remaining 20%. Although multiple robots are shown, it will be appreciated that one or more robots may programmed to cover some or all of aircraft, as desired.

Figure 2:
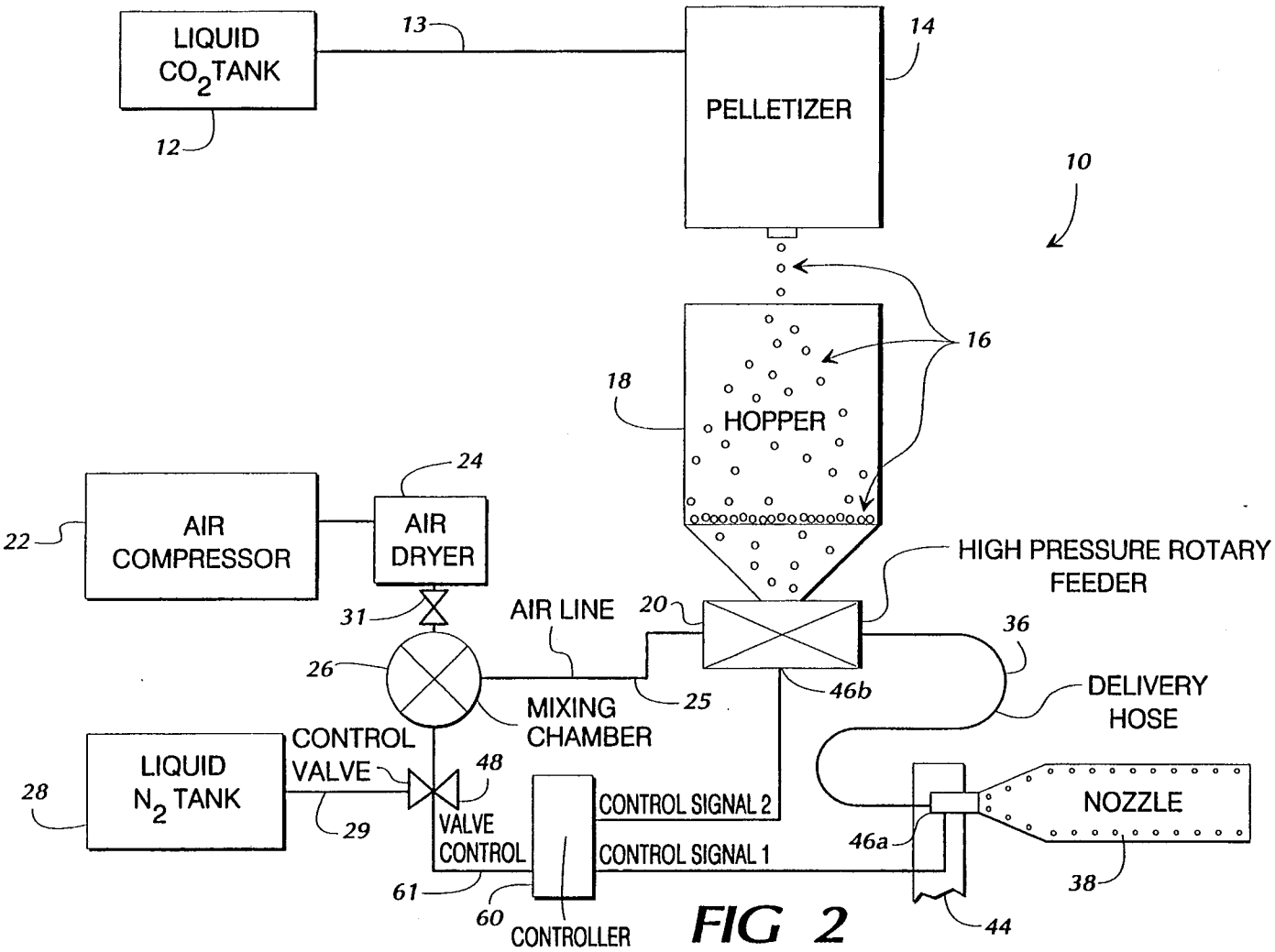
FIG. 2 is a schematic drawing of a $CO_2$ particle cleaning system constructed in accordance with the preferred embodiment of the present invention.
Figure 3:
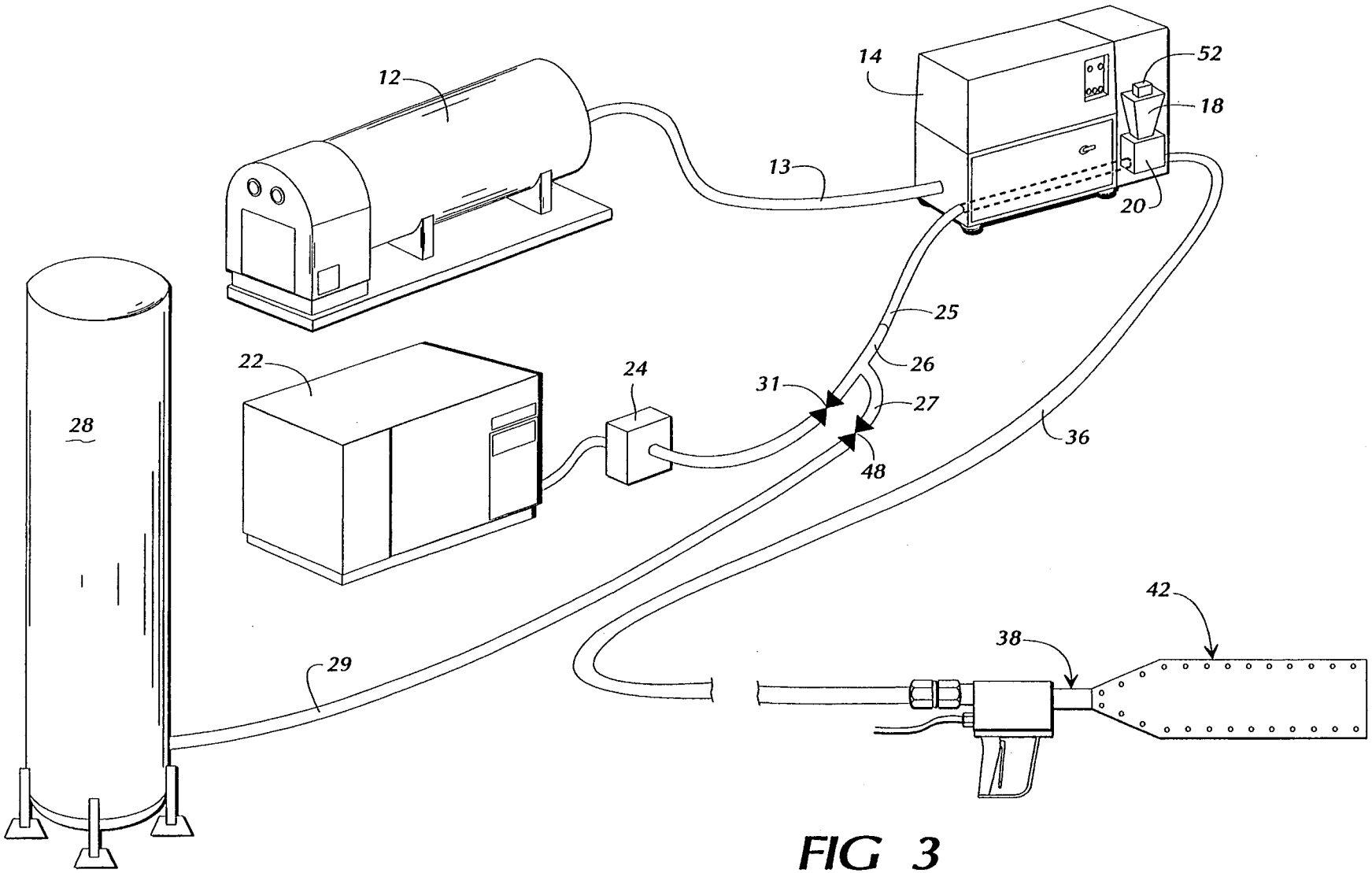
FIG. 3 is an isometric view of the $CO_2$ particle cleaning system components.

A schematic diagram of a typical preferred cleaning system 10 is shown in FIG. 2, and an isometric view of the components within the system is shown in FIG. 3. Referring first to FIG. 2, the preferred system 10 includes a liquid $CO_2$ storage tank 12. The liquid $CO_2$ storage tank supplies a $CO_2$ pelletizer 14 with liquid $CO_2$ through a liquid $CO_2$ supply line 13. The pelletizer 14 converts liquid $CO_2$ into solid $CO_2$ media comprising pellets 16.

The preferred $CO_2$ pelletizer 14 is a model 65-200, manufactured by Cold Jet, Inc., of Milford, Ohio, having a manufacturing capacity of 600 pounds of pellets per hour. The pellets are preferably cylindrical in shape and preferably about 0.040 inches in diameter. As will be understood by those skilled in the art, pellets of the preferred size are formed by use of a die having a plurality of openings sized at 0.040 inches. Carbon dioxide "snow" is forced through the die to form pellets of the indicated diameter, and cut into pellets having a length of about 0.25 inches internally of the preferred pelletizer. Further details concerning the pellet formation may be obtained by the manufacturer of the preferred pelletizer.

When using 0.040 inch diameter pellets, the problem of backside paint removal is reduced because the pellets are small enough that, upon impact, they do not impact the surface with sufficient force to damage or remove paint on the opposite side of the surface.

After the pellets 16 are formed by the pelletizer 14, they are fed into a hopper 18, where a supply of pellets accumulates. The hopper 18 provides a continuous and steady supply of pellets to a high pressure rotary feeder 20 that is operative to inject the pellets into a pressurized air stream, as will be described.

Air pressurized to about 300 pounds per square inch ("psi") is supplied to the rotary feeder 20 by an air compressor 22. As will be known to those skilled in the art, air compressors typically create an increase in the temperature of air from ambient as a result of the compression process. Typically, air compressors of the nature suitable for use in the present invention will provide pressurized air at about 100° F., depending upon factors such as ambient humidity and temperature. An air dryer 24 receives the high pressure air from the air compressor 22 and cools the pressurized air to no more than about 50° F. Preferably, the discharge dew point of the air discharged from the dryer 24 is −40° F. The cooler, high pressure air at approximately 50° F. is then provided from the air dryer 24 into a mixing chamber 26.

The mixing chamber 26 is a piping system including an expansion and contraction, valving, pressure gauges, and automated controls. As illustrated in FIG. 3, the preferred mixing chamber 26 is made of 1¼ inch diameter schedule 40 316 stainless steel pipe, with a 45° leg 27 for introducing the liquid $N_2$. The leg 27 is welded to a straight section of the mixing chamber 26, forming a 45° lateral. A 1 inch needle valve 31 is attached to the straight section prior to attachment of the leg 27 to control the warm or compressed air volume. A 1 inch cryogenic valve 48 is attached to the leg 27. Warm air enters through the needle valve 31 and mixes with liquid N2 entering through the valve 48 in leg 27. A pressure gauge (not illustrated) with feedback to the air compressor is also provided to monitor pressure in the system, to ensure that the preferred pressure of 300 psig is maintained.

Referring again to FIG. 2, the system 10 further includes a supply tank 28 for storing a supply of liquid nitrogen. The liquid nitrogen tank preferably stores at least 9000 gallons of liquid $N_2$, at a working pressure of 400 psig, with tank pressure regulation. The supply tank 28 is connected to the mixing chamber 26 by means of a vacuum jacketed hose 29, which is connected to a cryogenic globe control valve 48. The liquid nitrogen is injected at the mixing chamber 26 into the air fed to the rotary feeder to control pellet sublimation, as will be described. The injection of liquid nitrogen supercools the high pressure air to at least −120° F., which is below the sublimation point of solid carbon dioxide (which is −109.33° F.).

From the mixing chamber 26, the cooled high pressure air is provided via an air feed line 25 to the rotary feeder 20. At the rotary feeder, the pellets are injected into the supercooled air fed in via the line 25. From the rotary feeder, the combined pressurized air and pellets are fed into a delivery hose 36, at the end of which is connected a nozzle 38. The pellets are ejected from the nozzle 38 and directed against a surface to be cleaned.

In accordance with another aspect of the invention, the temperature of the system is monitored at several locations, to generate feedback control signals for controlling the injection of liquid $N_2$ into the pressurized air stream. These control signals are utilized to control the setting of the control valve 48 and thus the amount of liquid $N_2$ that is introduced into the air line 25. Preferably, at least two temperature sensors **46*a*, 46*b* are employed to measure and control the temperature in the delivery system, with a first sensor 46*a* mounted to monitor the temperature at the point of connection of the delivery hose 36 to the nozzle 38, and a second sensor 46*b* mounted to read the temperatures in the rotary feeder at the point of ejection of the air and pellets into the delivery hose 36. Each sensor 46** provides a signal proportional to the temperature, for feedback control.

Signals from the sensors **46*a*, 46*b*, denominated CONTROL SIGNAL 1 and CONTROL SIGNAL 2, are provided to a temperature controller 60, which is responsive to the control signals to provide a control signal on line 61 denominated VALVE CONTROL. This signal controls the opening and closing of the valve 48** to admit more liquid nitrogen if the temperature is higher (warmer) than a predetermined first set point, or less liquid nitrogen is the temperature is lower (colder) than a predetermined second set point. The first and second set points define a range of temperatures within which the temperature is preferably maintained, to prolong pellet life.

Figure 4:
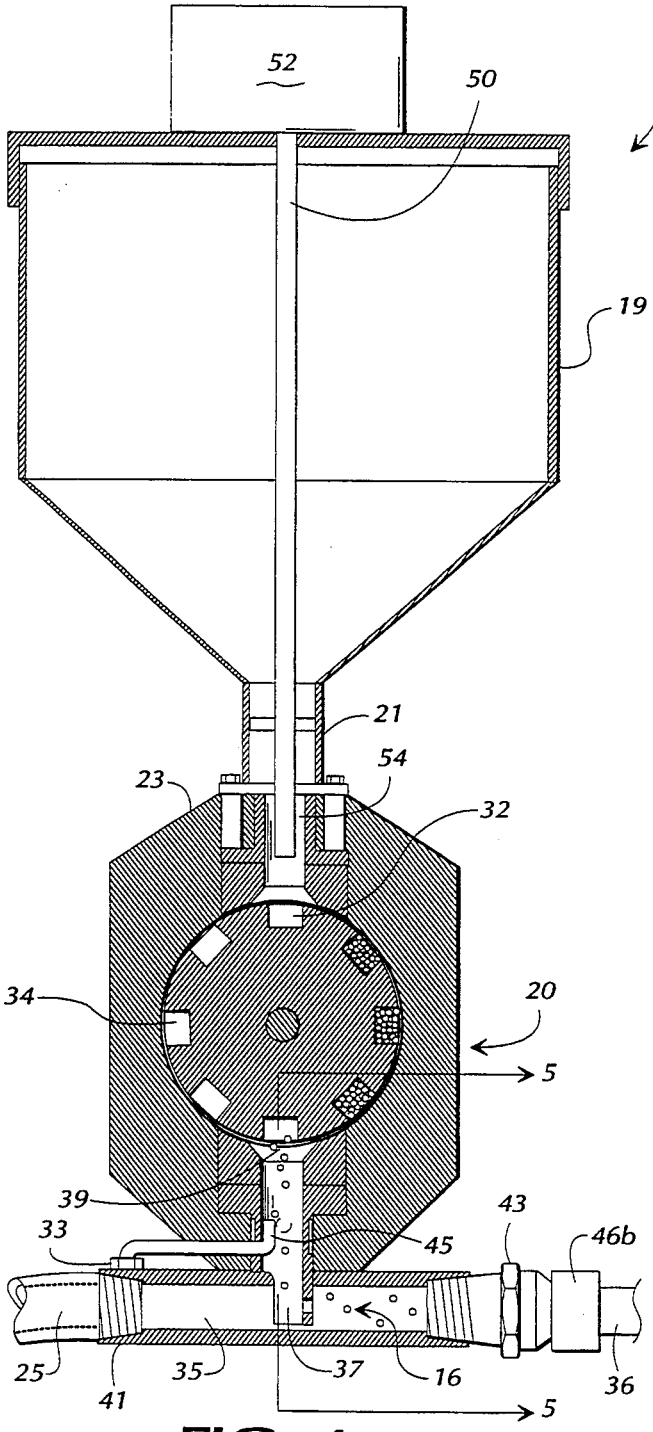
FIG. 4 is a cross sectional view of the hopper and feeder in operation.
Figure 5:
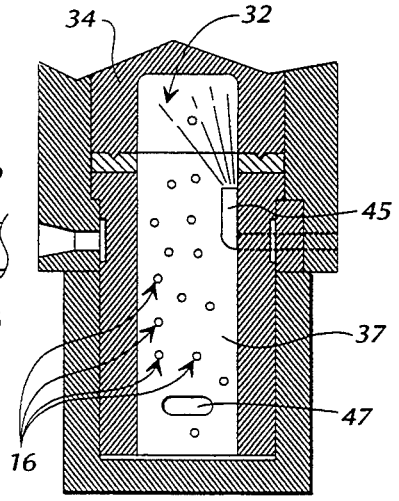
FIG. 5 is a partial cross sectional view of the hopper and feeder taken across the line 5—5 in FIG. 4.

As shown in more detail in FIGS. 4 and 5, the hopper 18 includes a body 19 and a chute 21. The chute 21 is connected to a feeder 20. The pellets 16 are collected in the body 19 of the hopper 18 and are forced by gravity downwardly into the chute 21 and thence into the feeder 20. The preferred hopper is a model 65-200 series 30 feeder assembly manufactured by Cold Jet, Inc. of Loveland, Ohio. Details of the preferred hopper are available in the literature supplied by the manufacturer. The preferred hopper accommodates up to 15 pounds of 0.040 inch pellets and provides a continuous flow to the feeder 20 at a maximum rate of at least 750 pounds per hour. As will be understood by those skilled in the art, properly sized fill, discharge, and purge openings are provided in the preferred hopper, and media level is sensed with a sensing means (not shown) to ensure continuous fill from the pelletizer.

As seen in FIG. 4, the preferred hopper 18 further includes a stir rod 50 that extends into the center of the body 19, for agitating the pellets contained therein and reducing occurrences of media bridges with their resultant voids. A pneumatic vibrator 52 is mounted to the exterior of the hopper 18. The vibrator preferably has a variable frequency of between about 30 Hz and about 140 Hz, with an applied force of about 20 lbs., which is considered sufficient to agitate the 0.040 pellets for movement without excessive pellet damage. When the vibrator 52 is activated, it causes the stir rod 50 to vibrate and reduce the tendency of the $CO_2$ pellets from sticking together. The rod 50 is slowly rotated by a motor (not shown) to further enhance the free flow of pellets. The pellets are also prevented from sticking together by slightly pressurizing the hopper with carbon dioxide in gaseous form. The gaseous carbon dioxide also reduces moisture in the hopper by preventing the intrusion of ambient air, which might contribute to undesirable pellet adhesion.

Still referring to FIG. 4, the rotary feeder 20 comprises means for introducing the pellets into a stream of pressurized air. The feeder includes a housing 23 for receiving the chute 21 of the hopper 18. The housing defines a passageway 54 that leads to a rotor lock 34. The rotor lock 34 includes a plurality of TEFLON®-lined cavities 32 that are recessed from the perimeter of the rotor lock. The rotor lock is rotated at a predetermined but controllable rate by a motor (not illustrated) to control the rate of pellet injection into the pressurized air.

As the rotor lock 34 rotates, each of a plurality of cavities 32 successively moves into position atop the rotor lock below the chute 21 and fills with pellets 16. The pellets 16 within the cavities 32 rotate clockwise until the cavity reaches a pellet discharge point at an outlet 39, positioned underneath the rotor lock 34. At the outlet 39, the pellets drop from the cavity 32 into a passageway 37 below the outlet 39.

The passageway 37 connects the pellet discharge outlet 39 to a channel 35 and feeds the pellets into an air stream passing through the channel. The channel 35 includes a threaded connector 41 that receives a mating connector on the air line 25. The channel 35 leads to an outlet connector 43 that is connected to the delivery hose 36.

As shown in FIGS. 4 and 5, an air jet 45 is positioned within the passageway 37 to direct pressurized air into a cavity 32 of the rotor lock 34 as the cavity moves into position to empty its contents into the passageway. The pressurized air is continuously directed into the cavity to help to empty the cavity of pellets and direct the flow of pellets into the channel 35. A T-connector or tap 33 is provided on the air line 25 to provide a source of air for the air jet 45.

It should be understood that the feeder 20 is preferably constructed with components that withstand the extreme cold of the liquid nitrogen. For example, conventional $CO_2$ feeders may experience failure of rubber "O"-ring type pressure seals because of the cold. Seal materials capable of withstanding the liquid $N_2$ are preferred. Since seal geometry, mating surfaces, and surface finish contribute to seal life, attention should be paid to these aspects of the feeder as well.

Figure 6:
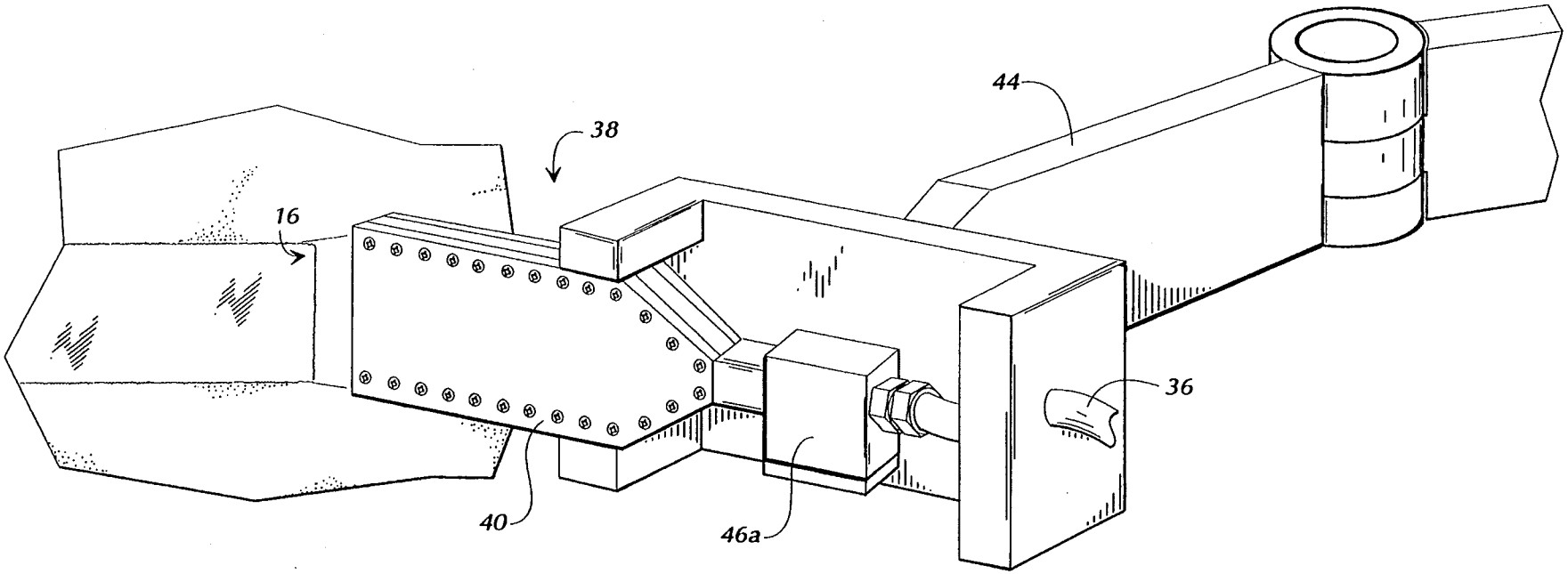
FIG. 6 is isometric view of the high pressure air nozzle mounted on a robotic arm.

Referring now to FIG. 6, the delivery hose 36 directs the flow of pressurized air, including the $CO_2$ pellets and injected liquid nitrogen, to the high pressure air nozzle 38. The delivery hose 36, which also should be capable of withstanding extreme cold, is preferably a corrugated flex hose such as a type 1502-20-3000 manufactured by Pacific Flex, Inc., Rancho Cucamonga, Calif. Preferably, hose length should be maintained at less than 35 feet to maximize the utility of the present invention to maintain the temperature sufficiently low during the travel of the pellets from the feeder 20 to the nozzle.

The preferred nozzle 38 comprises a wide, flat body 40 having an elongate, rectangular outlet approximately 0.140 inch thick. The nozzle body 40 is preferably about 5 inches wide, and preferably made of aluminum. The nozzle may be constructed as described in U.S. Pat. No. 5,050,805 to provide a supersonic output flow, or may be a four inch wide model 2E0073 manufactured by Cold Jet, Inc.

Internally of the nozzle 38, a converging-diverging shape is used to accelerate the gas. Preferably, the nozzle delivers 0.040 inch pellets at a maximum rate of 750 pounds per hour, with an average pellet speed at the target surface of 750 to 850 feet per second. A uniform pellet distribution is preferred to avoid local substrate damage. The nozzle preferably supports a minimum average paint removal rate of 0.48 square feet per minute.

The nozzle 38 is preferably mounted on the arm 44 of a robot for automatically removing paint from the surface of an aircraft, as shown in FIGS. 1 and 6. The mechanics and control systems for moving the nozzle 38 along a path disposed adjacent to the surface to be cleaned are not considered a part of the present invention.

In order to control the temperature of the high pressure air throughout the system, temperature sensors 46 are provided at various locations in the system. Two sensors **46*a*, 46*b* are provided in the preferred embodiment, although other sensors can be provided as needed. As shown in FIG. 6, one sensor 46*a* is located at the point of connection of the delivery hose 36 to the nozzle 38. The first sensor 46*a* provides a control signal CONTROL SIGNAL 1 (FIG. 2**), which varies in proportion to temperature variations between −120° F. and −150° F. It is preferred to maintain the temperature generally close to −120° F. to avoid excessive use of liquid nitrogen.

As shown in FIG. 4, a second sensor **46*b* is provided after the outlet connector 43 leading from the channel 35 of the feeder 20. The second sensor 46*b* provides a control signal CONTROL SIGNAL 2 (FIG. 2**), which varies in proportion to temperature variations between −110° F. and −120° F.

The temperature sensors 46 measure the temperature of the high pressure air and are utilized by the controller 60 to adjust the cryogenic valve 48 located between the liquid nitrogen storage tank 28 and the mixing chamber 26. The preferred temperature sensors 46 are both model 3856K57 "T" type thermocouples, available from McMaster-Carr, Atlanta, Ga. Details of the sensors are available in the literature supplied by the manufacturer. The sensors 46 provide a voltage that varies with temperature. As shown in FIG. 2, voltages from the sensors are provided as CONTROL SIGNAL 1 and CONTROL SIGNAL 2 to the controller 60.

The preferred controller 60 is a programmable electronic temperature controller such as a Model CN-2010 manufactured by Omega Engineering, Inc., Stamford, Conn., an APC Seriplex System with thermocouple input, analog output, on/off control, or the like. The controller is preferably programmed to provide a control signal, VALVE CONTROL, on line 61, that causes the valve 48 to open or close to maintain the temperature at or near the desired level.

The preferred control valve 48 is 1 inch cryogenic valve, model 49295K73 available from McMaster-Carr, or a Parker cryogenic analog control valve. Although automatic control of the valve 48 by an electronic controller 60 is preferred, it should be understood that the present invention also contemplates practice of a method for prolonging the life of the pellets by manually monitoring the temperature at the various locations, such as with a +100° to −320° F. cryogenic thermometer connected to the thermocouples 46, and manually adjusting the setting of the valve 48 to maintain the temperature within the operative range for maximum pellet life.

Either control signal from sensors 46*a*, 46*b* can cause the valve to open to its maximum (open) position, for maximum inflow of liquid $N_2$, when the temperature from its respective sensor reads a temperature at the maximum of the indicated range. Likewise, either control signal from sensors 46*a*, 46*b* can cause the valve to close to its minimum (closed) position, for minimum inflow of liquid $N_2$, when the temperature from its respective sensor reads a temperature at the minimum of the indicated range. Thus, when either sensor detects that the temperature being read is above the desired temperature, that is, the temperature at which pellet sublimation will occur, it will provide a control signal that opens the valve 48 to permit introduction of additional liquid $N_2$. In this manner, the amount of $N_2$ is controlled to minimize sublimation of pellets during their travel from the point of injection into the pressurized air, to the point of introduction into the nozzle 38.

Preferred rates of introduction of liquid $N_2$ in the preferred embodiment of the present invention from between about 2 gallons per minute (gpm) to a maximum of about 4 gpm. Usage of liquid $N_2$ in this range has been found to provide satisfactory operation of the present invention, with virtually 100% survival of 0.040 inch pellets delivered from the feeder 20 to the nozzle 38 utilizing a 35 foot delivery hose 36.

Regarding the nozzle 38, those skilled in the art will appreciate that present commercial blasting systems use one of two presently available types of nozzles—single hose and dual hose. The differences in these two approaches stems from the type of pellet delivery system used. A single hose nozzle receives pressurized gas and dry ice media at one location through a single hose. Hence, the pellets are introduced upstream of the nozzle. On the other hand, the dual hose nozzle receives high pressure gas through one hose and a second hose delivers the media at relatively low pressure. In this latter arrangement, the media is introduced at the nozzle. It will be understood that the present invention finds utility with both types of blasting systems, with the liquid $N_2$ injection for a single hose system being described herein as the preferred embodiment. For a dual hose system, the present invention preferably involves temperature monitoring and injection of $N_2$ for the pressurized air.

It has been observed that single hose nozzle designs have difficulty operating continuously and reliably at high media rates (above about 350 pounds of $CO_2$ pellets per hour) due to a tendency of the nozzle to clog and reduce the velocity of the pellets. However, with the use injection of liquid nitrogen to cool the compressed air in accordance with the present invention, this problem is substantially eliminated.

Since mixing liquid nitrogen with compressed air to lower the temperature allows a single hose nozzle design to operate using high media rates (above about 650 pounds of $CO_2$ per hour), it is possible to increase the width of single hose nozzles to above the conventional three inches. Nozzles having increased outlet widths, for example 5 inches, allow an increase in paint removal rates by increasing the surface area cleaned per unit time.

It has been further observed that increased media rates with increased width nozzles may under certain circumstances result in a slight decrease in the impact speed of the pellets. It may be that the increase in media flow rates increase the friction inside the nozzle, which in turn decreases the mean velocity of the gas, producing a lower pellet speed. Accordingly, increased nozzle width may require increased air pressures and other nozzle modifications.

Operation

When the $CO_2$ pelletizer 14 is activated, it receives liquid $CO_2$ from the liquid $CO_2$ storage tank 12 through the $CO_2$ supply line 13. Once the $CO_2$ pelletizer 14 begins producing pellets 16, the pellets are transferred into the hopper 18. The hopper 18 receives a volume of $CO_2$ pellets 16 into the body 19. The vibrator 52, secured to the stir rod 50, shakes the pellets 16 and prevents them from sticking together as they pass through the hopper 18. The $CO_2$ pellets pass from the hopper 18, through the chute 21, and into the cavities 32 of the rotor lock 34. Each cavity 32 receives a small volume of pellets from the chute 21, and delivers it into the passageway 37 of the feeder 20.

The air jet 45 directs pressurized air into the cavity 32 at the pellet discharge point 39, which causes the cavity to empty itself of pellets 16. The pellets 16 travel down the passageway 37 and into the channel 35 of the feeder 20. The pellets 16 and high pressure air flow from the feeder 20, through the delivery hose 36 and into the high pressure air nozzle 38. The robot arm 44 orients the nozzle 38 in a particular direction. The nozzle 38 propels the pellets 16 onto a surface to be cleaned. The impact of the pellets 16 on the surface causes any coatings, dirt, etc. on the surface, such as paint, to separate from the surface and fall off. Once the pellets 16 are exposed to ambient temperature and pressure, they quickly sublimate and leave only the paint particles as waste.

During operation, the temperature sensors 46 continually measure the temperature of the high pressure air at various points, at the beginning and end of the delivery hose 36 in the preferred embodiment. (However, it will be understood that temperature monitoring and control can occur at various points in the $CO_2$ pellet forming, accumulating, feeding, and delivery systems.) If the temperature at any of the sensors 46 exceeds −120° F., the controller 60 causes the valve 48 to open to allow additional liquid nitrogen to flow into the mixing chamber 26 and further cool the high pressure air. Conversely, if the temperature sensors 46 measure a temperature less than −130° F., the controller 60 causes the valve 48 to decrease the amount of liquid nitrogen injected into the mixing chamber 26. The preferred range of temperature for the high pressure air in this system is between −130° F. and −120° F., which is below the sublimation point of carbon dioxide (about −109° F.), thereby prolonging the lives of the pellets as they travel along the delivery hose 36.

It is further contemplated that the pellets 16 may be made from other elements or substances that are capable of sublimation, for example argon, and that other cryogenic materials, for example liquid helium, may be utilized for cooling. It is noted, however, that such other substances and cryogenic materials may not be as safe for the environment as $CO_2$ and $N_2$.

It will be appreciated that the embodiment discussed above is the preferred embodiment, falling within the scope of the appended claims, and that various alternative embodiments are contemplated. While the focus of this application has been principally on paint removal applications, it is anticipated that the present invention is equally applicable to the cleaning and/or removal of any matter from any surface. By way of example but not limitation, the present application is equally applicable to the removal of epoxy resin coatings from electronic circuit boards.

What is claimed is:

1. A system for cleaning a surface, comprising:
- means for forming frozen pellets for use as blasting media;
- means for delivering said pellets against a surface to be cleaned; and
- means for controlling the temperature within at least a portion of said delivery means to a temperature below the sublimation point of frozen pellets comprising:
  - means for monitoring the temperature in a conduit in said delivering means,
  - means responsive to signals from said temperature monitoring means for controlling a coolant injection valve, and
  - a source of coolant connected to said coolant injection valve, whereby when the temperature in said conduit exceeds a predetermined temperature of about −120° F., said coolant injection valve opens to introduce coolant into said conduit to maintain the temperature below the sublimation point of said frozen pellets.

2. The system of claim 1, wherein said delivering means comprises:
- collecting means for collecting said pellets;
- supply means for supplying pressurized air;
- introducing means for introducing said pellets from said collecting means into a stream pressurized air supplied by said supplying means;
- a conduit having opposing ends, said conduit connected at one end to said introducing means for receipt of said pellets and said pressurized air; and
- a nozzle connected to the opposing end of said conduit.

3. The system of claim 2, wherein said temperature controlling means comprises means for cooling said pressurized air.

4. The system of claim 3, wherein said cooling means comprises means for injecting coolant into said stream of pressurized air.

5. The system of claim 4, wherein said coolant is liquid nitrogen.

6. The system of claim 2, wherein said forming means comprises a carbon dioxide pelletizer.

7. The system of claim 2, wherein said collecting means comprises a hopper.

8. The system of claim 2, wherein said introducing means comprises a rotary feeder.

9. The system of claim 2, wherein said nozzle is a single hose nozzle.

10. The system of claim 1, wherein said pellets are cylindrically shaped.

11. The system of claim 10, wherein said pellets are 0.040 inches in diameter.

12. A system for cleaning a surface comprising:
- forming means forming carbon dioxide pellets;
- collecting means for collecting said pellets;
- supply means for supplying pressurized air;
- introducing means for introducing said pellets from said collecting means into a stream of high pressure air supplied by said supplying means;
- a conduit having opposing ends, said conduit connected at one end to said introducing means for receipt of said pellets and said pressurized air;
- a high pressure nozzle connected to the opposing end of said conduit;
- cooling means for cooling said high pressure air; and
- a control means comprising means for monitoring the temperature in the interior of said conduit, and means responsive to signals from said temperature monitoring means for controlling said cooling means to maintain a predetermined temperature of about −120° F. of said high pressure air.

13. The system of claim 12, wherein said forming means comprises a carbon dioxide pelletizer.

14. The system of claim 13, wherein said pellets are 0.040 inches in diameter.

15. The system of claim 12, wherein said collecting means comprises a hopper.

16. The system of claim 12, wherein said supply means is an air compressor.

17. The system of claim 12, wherein said introducing means comprises a rotary feeder.

18. The system of claim 12, wherein said nozzle is a single hose nozzle.

19. The system of claim 12, wherein said cooling means comprises an injection means for injecting coolant into said stream of high pressure air.

20. The system of claim 19, wherein said injecting means comprises a valve.

21. The system of claim 19, wherein said coolant is liquid nitrogen.

22. The system of claim 12, wherein said pellets are cylindrically shaped.

23. A method for cleaning a surface, comprising the steps of:
- forming pellets made of carbon dioxide;
- collecting the pellets in a hopper;
- providing a source of pressurized air;
- introducing the pressurized air into a feeder;
- introducing the pellets from the hopper into the feeder to combine the pellets and the pressurized air;
- maintaining the temperature of the pressurized air at a predetermined temperature level comprising the steps of:
  - measuring the temperature of the pressurized air; and
  - controlling the introduction of a coolant into the pressurized air in correspondence with the temperature of the pressurized air, to maintain the temperature below the sublimation point of carbon dioxide; and
- propelling the pellets onto a surface to be cleaned.

24. The method of claim 23, wherein the pellets are cylindrically shaped.

25. The method of claim 23, wherein said pellets are 0.040 inches in diameter.

26. The method of claim 23, wherein the pellets are propelled by means of a nozzle against the surface to be cleaned.

27. The method of claim 23, wherein the step of maintaining the temperature comprises injecting coolant into the pressurized air.

* * * * *